US007179175B2

(12) United States Patent
Kennedy, III

(10) Patent No.: US 7,179,175 B2
(45) **Date of Patent: *Feb. 20, 2007**

(54) GOLF CLUB HAVING STEPPED GROOVES

(75) Inventor: Thomas J. Kennedy, III, Wilbraham, MA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/446,667

(22) Filed: Jun. 5, 2006

(65) Prior Publication Data

US 2006/0223648 A1 Oct. 5, 2006

Related U.S. Application Data

(63) Continuation of application No. 10/748,052, filed on Dec. 30, 2003, now Pat. No. 7,056,226.

(51) Int. Cl.
*A63B 53/04* (2006.01)

(52) U.S. Cl. ..... 473/330

(58) Field of Classification Search ..... 473/423–350; D21/750

See application file for complete search history.

(56) References Cited

U.S. PATENT DOCUMENTS 4,754,971 A 7/1988 Kobayashi
4,846,477 A * 7/1989 Phelan ..... 473/330
4,858,929 A 8/1989 Long
4,957,294 A * 9/1990 Long ..... 473/350
5,029,864 A 7/1991 Keener
5,437,088 A * 8/1995 Igarashi ..... 29/527.6
5,591,092 A * 1/1997 Gilbert ..... 473/330
5,618,239 A 4/1997 Rife
5,688,186 A 11/1997 Michaels et al.
5,709,616 A 1/1998 Rife
5,755,626 A * 5/1998 Shira ..... 473/330
5,766,087 A 6/1998 Kawamatsu
6,348,010 B1 2/2002 Doolen
6,368,231 B1 4/2002 Chen
6,398,665 B1 6/2002 Antonious
6,719,644 B2 4/2004 Beach
6,733,400 B2 5/2004 Sherwood
6,814,673 B2 11/2004 Wahl et al.
6,981,923 B2 1/2006 Chappell (Continued)

FOREIGN PATENT DOCUMENTS

JP 05317463 A * 12/1993

(Continued)

*Primary Examiner*—Eugene Kim
*Assistant Examiner*—Alvin A. Hunter, Jr.
(74) *Attorney, Agent, or Firm*—Michael A. Catania; Elaine H. Lo

(57) ABSTRACT

A golf club head is characterized by stepped grooves in the striking face thereof. The grooves may have a V-shape or a U-shape. The V-shaped grooves have side walls that intersect at the bottom of the grooves, while the U-shaped grooves have side walls that terminate at opposite ends of a bottom wall, which preferably is parallel to the striking face. At least one side wall of the grooves contains at least one step portion, so that the grooves have a stepped configuration. The stepped grooves impart more consistent spin to a golf ball when struck by the club head.

11 Claims, 2 Drawing Sheets

U.S. PATENT DOCUMENTS 7,014,568 B2 * 3/2006 Pelz ..... 473/287
7,056,226 B2 * 6/2006 Kennedy ..... 473/330

FOREIGN PATENT DOCUMENTS

JP 09070457 A * 3/1997
JP 09192274 A * 7/1997
JP 10248974 A * 9/1998
JP 2001178856 A * 7/2001

* cited by examiner

GOLF CLUB HAVING STEPPED GROOVES

CROSS REFERENCES TO RELATED APPLICATIONS

The present application is a continuation of U.S. patent application Ser. No. 10/748,052, which was filed on Dec. 30, 2003 now U.S. Pat. No. 7,056,226.

STATEMENT REGARDING FEDERALLY SPONSORED RESEARCH OR DEVELOPMENT

Not Applicable

BACKGROUND OF THE INVENTION

1. Field of the Invention

The present invention relates to a golf clubs having grooves.

2. Description of the Related Art

The striking face of most golf clubs, and particular golf club irons, contains a plurality of parallel grooves to provide a more consistent spin to the golf ball when struck. More consistent spin allows for more consistent shots. With short irons, the more consistent shots also enable the skilled golfer to control the landing of a golf ball on the green.

The United States Golf Association ("USGA") has set certain standards for grooves in a golf club. Specifically, the grooves must be straight, have diverging sides, and have a symmetrical cross-section. The width, depth, and spacing of the grooves are also set forth in the USGA standards.

The present invention relates to a stepped or serrated groove configuration for golf club heads which conforms with USGA standards and also improves the consistency of the club.

Various groove configurations for golf club heads are known in the prior art. For example, the Chappell U.S. published patent application No. 2002/0042306 discloses a golf club with modified grooves which increase the backspin on a struck golf ball. In one embodiment, an angled slot groove configuration includes a chamfered edge and three separate surfaces. Other embodiments include Y-shaped grooves and angled slot grooves with double chamfered surfaces. In the Rife U.S. Pat. No. 5,618,239, there is disclosed a putter having grooves of angled or trapezoidal configurations.

While these types of grooves, as well as conventional square or V-shaped grooves with straight side walls, perform satisfactorily, there is a limit as to the consistency of spin that they can impart to a golf ball because of the limited edges of the grooves that contact the ball. The present invention was developed in order to overcome these and other drawbacks of the prior art by providing a golf club with stepped or serrated grooves which comply with USGA standards.

BRIEF SUMMARY OF THE INVENTION

Accordingly, the present invention relates to a golf club head including a body having a striking face portion containing a plurality of spaced, parallel grooves. The grooves are defined by a pair of opposed diverging side walls extending from within the body to the striking face portion. At least one side wall contains at least one step portion so that the grooves have a stepped configuration. Preferably, both side walls contain a step portion.

The grooves have an axis which extends normal to the striking face portion and through the mid-point at the bottom of the groove. The side walls on opposite sides of the groove axis are symmetrical.

The grooves may have a V-shape or a U-shape. The V-shaped grooves have side walls which intersect at the bottom of the grooves. The U-shaped grooves have side walls that terminate at opposite ends of a bottom wall which preferably is parallel to the striking face.

The step in each groove side wall divides, the side wall into first and second portions. These portions can be parallel but need not be.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
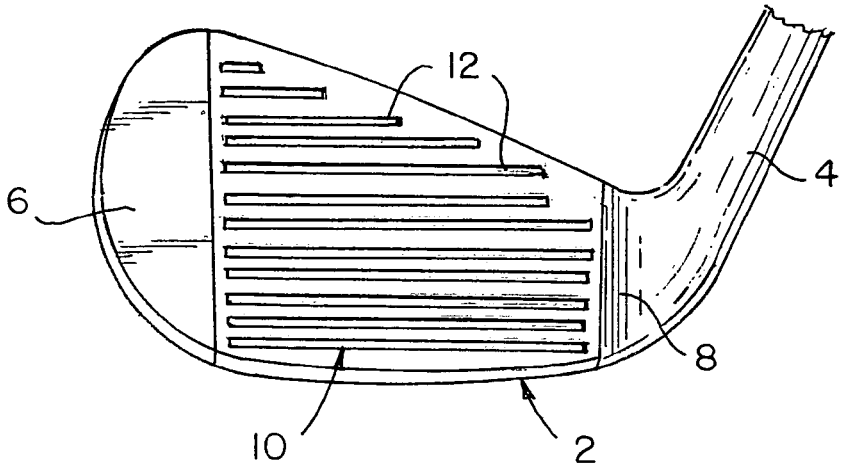
FIG. 1 is a front plan view of a golf club head incorporating grooves according to the invention.
Figure 2:
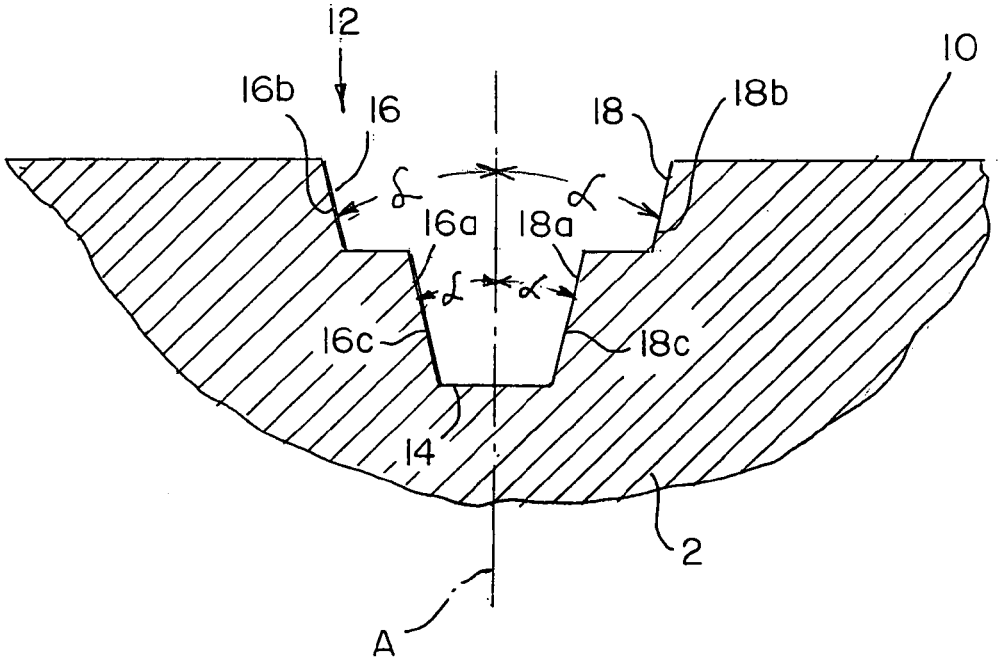
FIGS. 2–6 are cross-sectional views of grooves having different configurations in accordance with different embodiments of the invention, respectively.

In FIG. 1 is shown a golf club head of the iron type. The head includes a body 2 having a hosel 4, a toe portion 6, a heel portion 8, and a striking face portion 10 containing a plurality of straight, parallel, spaced grooves 12. While the invention is directed toward grooves for an iron type golf club head, the grooves may also be provided in wood type club heads or in putter heads. Referring to FIG. 2, a cross section of a groove 12 according to a preferred embodiment is shown. The groove has an axis A which extends normal to the striking face portion 10 through the middle of the groove bottom wall 14. On opposite sides of the axis, the groove is defined by side walls 16, 18 which diverge from within the club head body 2 toward the striking face portion 10.

The side wall 16 contains at least one step portion 16*a* which divides the side wall into first 16*b* and second 16*c* portions. Similarly, the side wall 18 contains at least one step portion 18*a* which divides the side wall into first 18*b* and second 18*c* portions. Preferably, the first and second portion 16*b*, 16*c* of the side wall 16 are parallel. That is, they are arranged at the same angle $\alpha$ relative to the axis A. Similarly, the first and second portions 18*b*, 18*c* of the side wall 18 are also parallel and arranged at the same angle $\alpha$ as the side wall 16 so that the walls are symmetrical. The general configuration of the groove 12 is a U-shape.

Figure 4:
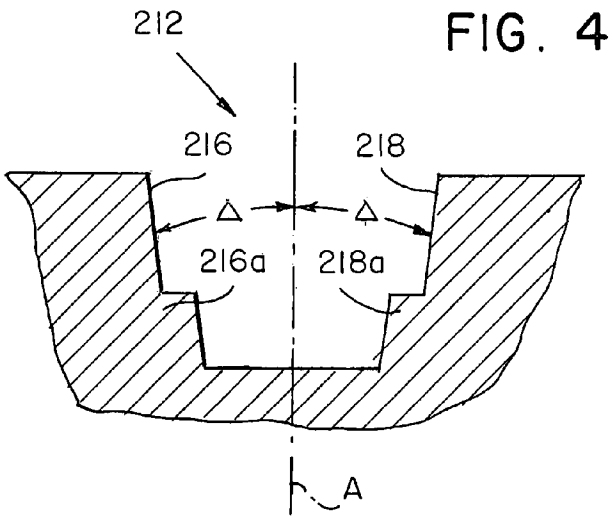
Figure 3:
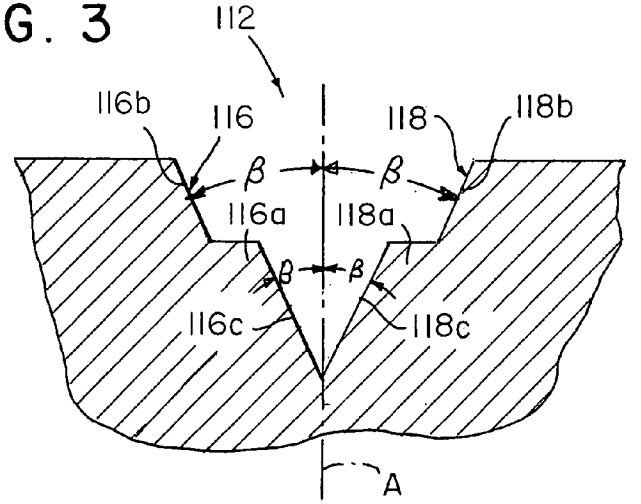

In FIG. 3 is shown a second embodiment of a V-shaped groove 112. In this embodiment, the side walls 116 and 118 intersect at the bottom of the groove. Thus, there is no flat bottom wall in the groove as there is with the groove 12 of FIG. 2. The side walls 116, 118 each contain a step 116*a*, 118*a* so that the groove is stepped. The first and second portions 116*b*, 116*c*; 118*b*, 118*c* of the respective side walls are arranged at the same angle $\beta$ relative to the axis. FIG. 4 illustrates a third embodiment for a stepped groove 212 according to the invention. As compared to the groove in FIG. 2, the angle $\Delta$ between the side walls 216, 218 and the axis is less than the angle $\alpha$ of FIG. 2. This results in a groove with a wider bottom wall. Steps 216*a* and 218*a* are provided in the side walls 216, 218, respectively.

Figure 5:
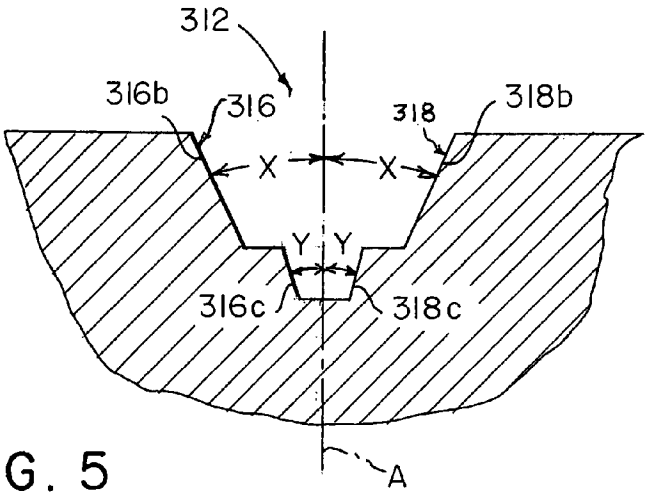

In the embodiment of FIG. 5, a serrated groove 312 is defined by side walls 316, 318 having steps 316*a*, 318*a*, respectively. In this embodiment however, the first and second portions 316*b*, 316*c* of the side wall 316 are not parallel. Rather, the angle x between the first wall portion 316*b* and the axis A is greater than the angle y between the second wall portion 316*c* and the axis A. Similarly, the angle x between the first wall portion 318*b* and the axis A is greater than the angle y between the second wall portion 318*c* and the axis A. Alternatively, the angle y could be greater than the angle x.

From these embodiments, it is apparent that a variety of stepped groove configurations can be defined by various stepped side walls. The step in the walls can be arranged anywhere along the length of the wall, although it is preferable to arrange it higher or closer to the striking face surface.

When a ball is struck by a club head incorporating stepped grooves according to the invention, the cover of the ball is caught by the edges of the grooves. These edges include the area where the side walls meet the striking face surface and the area adjacent to each step. Thus, a greater surface area of the ball is caught by the grooves of the invention to impart more consistent spin on the ball.

While the invention has been described as conforming with USGA standards, the principles thereof can be applied to non-conforming clubs. Thus, the axis A of the grooves need not be normal to the striking face of the club head body. The side walls can be arranged normal to the striking face, rather than diverging, to define square grooves.

Figure 6:
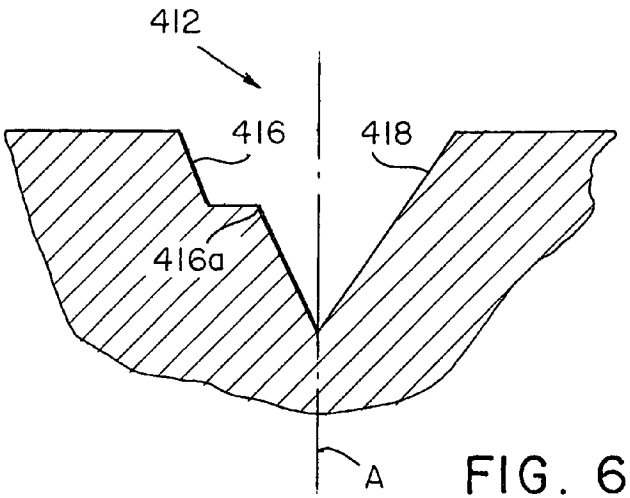

If desired, a step or steps need only be provided in one of the groove side walls. In FIG. 6 is shown such a groove 412. The side wall 416 contains at least one step portion 416*a*, whereas the side wall 418 is linear. The angles between the side walls 418 and the axis A can be equal or they may be different.

It is preferable for all of the grooves on the club to have the same configuration. However, it is possible to provide differently configured grooves across the club face. For example, stepped grooves can be provided toward the sole of the club with non-stepped grooves toward the top.

Testing of a golf club of the sand wedge type incorporating stepped grooves as shown in FIG. 2 has been conducted to determine the effect of the stepped grooves on the backspin of a struck golf ball relative to a ball struck by a conventional sand wedge. In Table 1 are set forth the test results for a sand wedge according to the invention striking a golf ball 12 times under controlled conditions.

TABLE ONE

| | Launch Angle | Ball Speed | Back Spin |
|---|---|---|---|
| Average | 26.7 | 130.3 | 10438 |
| StDev | 0.30 | 0.49 | 199 |
| Min | 26.0 | 129.4 | 10018 |
| Max | 27.3 | 131.3 | 10854 |
| Count | 12 | 12 | 12 |

In Table Two are the test results for a conventional sand wedge such as a BEN HOGAN® 5612 sand wedge.

TABLE TWO

| | Launch Angle | Ball Speed | Back Spin |
|---|---|---|---|
| Average | 27.4 | 128.6 | 10434 |
| StDev | 0.34 | 0.47 | 246 |
| Min | 26.7 | 127.9 | 10192 |
| Max | 27.9 | 129.2 | 11047 |
| Count | 12 | 12 | 12 |

Finally, means (t) and variability (F) tests were conducted to determine the probability that the stepped groove club differs from the conventional club and the probability that the variation is less than in the conventional club, respectively. Those results are shown in Table Three.

TABLE THREE

| | Launch Angle | Ball Speed | Back Spin |
|---|---|---|---|
| t-Test | 100.0% | 100.0% | 51.7% |
| F-Test | 66.5% | * | 75.2% |

* denotes that conventional club has less variation

The test results indicate that the probability that either club spins the ball more than the other club is 51.7%. That is, the spin differential between the clubs is small enough as to be insignificant. However, the variability test results show that the stepped groove club is more consistent than the conventional club 75.2% of the time.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

I claim as my invention:

1. A golf club head, comprising:

a body including a striking face portion containing a plurality of spaced, parallel grooves, each of the spaced parallel grooves being defined by a pair of opposed side walls extending from within said body to said striking face portion, at least one of the opposed side walls having a first portion, a second portion and a step portion, the second portion being located on an opposite side of the step portion than the first portion and parallel to the first portion.

2. The golf club head according to claim 1, wherein each of the opposed side walls has a first portion, a second portion and a step portion.

3. The golf club head according to claim 2, wherein the opposed side walls have a symmetrical configuration relative to an axis extending normal to the striking face portion and through the middle of each of the spaced, parallel grooves.

4. The golf club head according to claim 3, wherein the angle defined between the first portion and the axis is different from the angle defined between the second portion and the axis.

5. The golf club head according to claim 4, wherein the angle defined between the first portion and the axis is greater than the angle defined between the second portion and the axis.

6. The golf club head according to claim 1, wherein the first and second portions are substantially parallel.

7. The golf club head according to claim 1, wherein the step portion is substantially parallel to the striking face portion.

8. The golf club head according to claim 1, wherein the opposed side walls intersect within the body to define V-shaped grooves.

9. The golf club head according to claim 1, wherein the opposed side walls terminate at opposite ends of a bottom wall to define U-shaped grooves.

10. The golf club head according to claim 9, wherein the bottom wall is substantially parallel to the striking face portion.

11. The golf club head according to claim 10, wherein the step portion is substantially parallel to the striking face portion.

* * * * *